US011608799B2

(12) United States Patent
Wickman et al.

(10) Patent No.: US 11,608,799 B2
(45) Date of Patent: Mar. 21, 2023

(54) WET BIOFUEL COMPRESSION IGNITION

(71) Applicant: Wisconsin Alumni Research Foundation, Madison, WI (US)

(72) Inventors: David Darin Wickman, Madison, WI (US); Sage Lucas Kokjohn, Oregon, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 0 days.

(21) Appl. No.: 17/569,873

(22) Filed: Jan. 6, 2022

(65) Prior Publication Data

US 2022/0213849 A1 Jul. 7, 2022

Related U.S. Application Data

(60) Provisional application No. 63/134,741, filed on Jan. 7, 2021.

(51) Int. Cl.

| | |
|---|---|
| ***F02M 25/022*** | (2006.01) |
| ***F02M 25/03*** | (2006.01) |
| ***F02M 25/038*** | (2006.01) |
| ***F02M 21/02*** | (2006.01) |
| ***F02B 7/02*** | (2006.01) |
| ***F02M 21/06*** | (2006.01) |

(52) U.S. Cl.

CPC ..... *F02M 21/0206* (2013.01); *F02B 7/02* (2013.01); *F02M 21/0245* (2013.01); *F02M 21/06* (2013.01); *F02M 25/022* (2013.01); *F02M 25/03* (2013.01); *F02M 25/038* (2013.01); *F02B 2201/064* (2013.01)

(58) Field of Classification Search

CPC ..... F02M 25/022; F02M 25/03; F02M 25/038
USPC ..... 123/1 A, 25 C, 25 D, 25 E, 25 F, 557
See application file for complete search history.

(56) References Cited

U.S. PATENT DOCUMENTS

| | | | |
|---|---|---|---|
| 6,010,544 | A | 1/2000 | Haldeman |
| 6,170,441 | B1 | 1/2001 | Haldeman |

(Continued)

FOREIGN PATENT DOCUMENTS

| | | |
|---|---|---|
| CA | 868821 | 4/1971 |
| CN | 103403130 A | 11/2013 |

(Continued)

OTHER PUBLICATIONS

Abstract to Martins, M., Lanzanova, T., and Sari, R., "Low Cost Wet Ethanol for Spark-Ignited Engines: Further Investigations," SAE Int. J. Fuels Lubr. 8(2):367-373, 2015, https://doi.org/10.4271/2015-01-0954 (Year: 2015).

(Continued)

*Primary Examiner* — Erick R Solis
(74) *Attorney, Agent, or Firm* — Craig Fieschko; DeWitt LLP

(57) ABSTRACT

A compression ignition engine system allows use of hydrous fuels, in particular hydrous biofuels, with high water content (e.g., 20-85% water). The hydrous fuel is pressurized, and also preferably heated via the engine's exhaust gas, to increase its enthalpy, and is then directly injected into the engine cylinder(s) near top dead center. The system provides brake thermal efficiency increases of 20% or more versus a comparable system using conventional diesel fuel, while allowing the use of inexpensive undistilled or lightly distilled biofuels.

20 Claims, 1 Drawing Sheet

(56) References Cited

U.S. PATENT DOCUMENTS

| | | | | |
|---|---|---|---|---|
| 6,213,104 | B1 | 4/2001 | Ishikiriyama | |
| 6,240,883 | B1 * | 6/2001 | Ahern | F23K 5/04 123/25 R |
| 6,487,994 | B2 * | 12/2002 | Ahern | F23K 5/04 123/25 R |
| 6,843,220 | B2 | 1/2005 | Lauesch | |
| 6,899,859 | B1 | 5/2005 | Olsvik | |
| 7,449,034 | B1 * | 11/2008 | Mikkelsen | C10L 1/026 44/302 |
| 7,931,711 | B2 | 4/2011 | Wootton | |
| 8,616,177 | B2 | 12/2013 | Reitz et al. | |
| 9,926,837 | B2 | 3/2018 | Gruber | |
| 9,957,888 | B2 | 5/2018 | Lissianski et al. | |
| 10,794,340 | B2 | 10/2020 | Kokjohn | |
| 11,125,170 | B2 | 9/2021 | Kokjohn | |
| 2006/0107586 | A1 | 5/2006 | Tavlarides | |
| 2008/0000445 | A1 | 1/2008 | Kim | |
| 2011/0088656 | A1 | 4/2011 | Simmons et al. | |
| 2013/0291826 | A1 * | 11/2013 | McAlister | F02D 41/0025 123/254 |
| 2013/0318946 | A1 | 12/2013 | Morris et al. | |
| 2014/0109866 | A1 | 4/2014 | Gruber | |
| 2014/0251278 | A1 | 9/2014 | De Boer | |
| 2015/0198085 | A1 | 7/2015 | McCann | |
| 2015/0300299 | A1 | 10/2015 | Licitar | |
| 2016/0230705 | A1 * | 8/2016 | Sher | F02M 57/00 |
| 2016/0265416 | A1 | 9/2016 | Ge | |

FOREIGN PATENT DOCUMENTS

| | | | | |
|---|---|---|---|---|
| DE | 102017106571 | A | 5/2017 | |
| EP | 0790395 | A2 | 8/1997 | |
| EP | 1106803 | A2 * | 6/2001 | F02B 3/08 |
| JP | 6262268 | A | 1/2018 | |
| RU | 2615291 | | 4/2017 | |
| WO | WO 2008106722 | A1 | 9/2008 | |
| WO | WO 2013075832 | | 12/2013 | |

OTHER PUBLICATIONS

Azimov et al., Combustion Characteristics of Syngas and Natural Gas in Micro-pilot Ignited Dual-fuel Engine, *World Academy of Science, Engineering and Technology International Journal of Mechanical and Mechatronics Engineering*, 2012, vol. 6, No. 12:2863-2870.

Barendregt et al., Development of a supercritical Diesel Reformer in a Hybrid Fuel Cell System, Defense Material Organization, Sep. 2003-Oct. 2010.

Boukis, et al., Methanol Reforming in Supercritical Water, *Ind. Eng. Chem. Res.*, 2003, 42:728-735.

Chuahy, F.D.F. and Kokjohn, S.L., "High Efficiency Dual-Fuel Combustion through Thermochemical Recovery and Diesel Reforming", *Applied Energy*, 2017 https://doi.org/10,1016/j.apenergy.2017.03.078.

Hagos et al., Trends of Syngas as a Fuel in Internal Combustion Engines, *Advances in Mechanical Engineering*, 2014, vol. 2014, Article ID 401587, pp. 1-10.

Mahgoub et al., Performance Study of Imitated Syngas in a Dual Fuel Compression Ignition Diesel Engine, *International Journal of Automotive and Mechanical Engineered* (*IJAME*), 2015, vol. 11, pp. 2282-2293 (ISSN: 2229-8649 (Print); ISSN: 2180-1606 (Online) DOI: http://dx.doi.org/10.15282/ijame.11.2015.11.0192.

Picou, Jason W., Autothermal non-catalytic reformation of jet fuel in a supercritical water medium, (2008), *Masters Thesis*, Paper 4675.

Rahnama, P.; Paykani,A.; Bordbar, V.; Reitz, R.D. A numerical study of the effects of reformer gas composition on the combustion and emission characteristics of a natural gas/diesel RCCI engine enriched with reformer gas. Fuel 2017, 209, 742-753. (Year: 2017).

Rahnama, P.; Paykani, A.; Reitz, R.D. A numerical study of the effects of using hydrogen, reformer gas and nitrogen on combustion, Reference Delivery Request emissions and load limits of a heavy duty natural gas/diesel RCCI engine. Appl. Energy 2017, 193, 182-198. (Year: 2017).

Sahoo et al., Abstract—Effect of $H_2O$:CO ratio in syngas on the performance of a dual fuel diesel engine operation, *Applied Thermal Engineering*, 2012, vol. 49, pp. 139-146.

Wagemakers et al., Review on the Effects of Dual-Fuel Operation, Using Diesel and Gaseous Fuels, on Emissions and Performance, *SAE International Journal of Engines*, 2012, DOI: 10.4271/2012-01-0869.

PCT International Search Report, PCT/US2019/014764, dated Jan. 3, 2020.

PCT Written Opinion, PCT/US2019/014764, dated Jan. 3, 2020.

Nazha et al., the Use of Emulsion, Water Induction and EGR for Controlling Diesel Engine Emissions, SAE 2010 Commercial Vehicle Engineering Congress SAE Technical Papers, *Society of Automotive Engineers, Inc U.S.*, 2001, XP002225916, ISSN: 0148-7191.

International Search Report and Written Opinion, PCT/US2022/011409, dated Apr. 21, 2022.

* cited by examiner

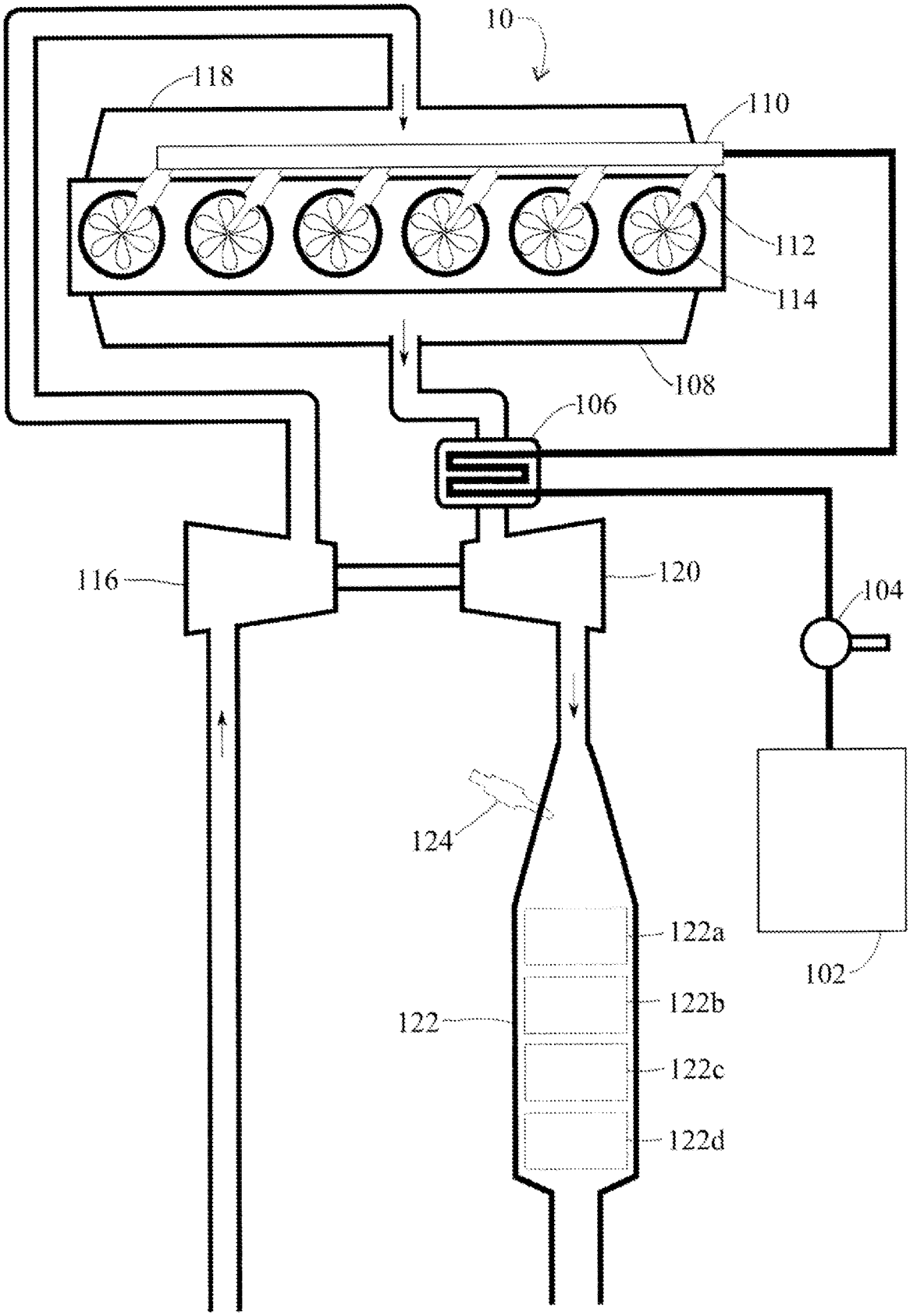
10
118
110
112
114
108
106
116
120
104
124
122a
102
122b
122
122c
122d

WET BIOFUEL COMPRESSION IGNITION

STATEMENT REGARDING FEDERALLY SPONSORED RESEARCH

This invention was made with government support under DE-SC0020087 awarded by the US Department of Energy. The government has certain rights in the invention.

FIELD OF THE INVENTION

This document concerns an invention relating generally to compression ignition (diesel) combustion engines, and more specifically to compression ignition of hydrous (aqueous or "wet") fuels, in particular hydrous biofuels (biofuels containing water, e.g., hydrous alcohols such as hydrous ethanol and/or methanol, hydrous ethers such as hydrous dimethyl ether (DME), etc.).

BACKGROUND OF THE INVENTION

A prior patent (U.S. Pat. No. 11,125,170 issued Sep. 21, 2021, also published as US20200182165, the entirety of this being incorporated by reference into this document) describes efforts to efficiently use a biofuel, in particular hydrous ethanol, as a fuel for a compression ignition (diesel) engine. Hydrous ethanol, also known as aqueous or wet ethanol, is a typical product from ethanol production, consisting of a solution of anhydrous ethanol (dehydrated or dry ethanol) and water (often 85%-90% water for "raw" hydrous ethanol produced directly from fermentation processes). Hydrous ethanol is a poor fuel, and requires expensive and energy-consuming distilling/dehydration steps to convert it to a sufficiently water-free state that it is suitable for typical use as a fuel. Typically, less than 1% water is desired, but as water content decreases, increasing amounts of energy are needed for further dehydration (e.g., it takes far less energy to dehydrate from 90% water to 50% water than it does to dehydrate from 50% to 10% water). This adversely impacts the status of ethanol as a "carbon-neutral" fuel, as the energy needed to make it fuel-worthy approaches the amount of energy needed to produce the fuel. The aforementioned patent application describes a diesel engine system wherein a reformer—a device which converts hydrocarbons and water to syngas, a gas mixture which contains hydrogen (H2) and other gases such as carbon monoxide (CO)—processes hydrous ethanol to provide syngas for use in a diesel engine alongside another fuel (e.g., conventional diesel fuel). This beneficially allows the use of hydrous ethanol as a fuel without the need for energy-consuming dehydration, decreasing fuel production costs and making production more "carbon-neutral." Moreover, the described system beneficially provides minimal engine emissions/pollutants, avoiding the need for engine exhaust after-treatment measures, which can be expensive and cumbersome. However, the described system requires a reformer, which can itself generate costs, as well as volume and placement issues on a vehicle wherein the system is installed.

SUMMARY OF THE INVENTION

The invention, which is defined by the claims set out at the end of this document, is directed to a compression ignition (diesel) engine system allowing direct use of hydrous fuels without the need for a reformer. The hydrous fuels contain at least 20% water by mass, and more preferably at least 40% water by mass, with the remainder being one or more combustible fuels such as alcohol (e.g., ethanol), dimethyl ether (DME), hydrogen ($H_2$), or diesel fuel (whether derived from petroleum or biomass).

The hydrous fuel is pressurized to a level suitable for direct injection (e.g., 50 bar or more) near top dead center (TDC) of the compression stroke of a compression ignition engine. The pressurization of the fuel mixture in a low temperature liquid state requires negligible parasitic power consumption. The high pressure, low temperature fuel is then preferably heated to high temperature (preferably 500 K or more) prior to injection, as by use of a recuperator (heat exchanger) utilizing waste heat from the engine's exhaust system. The fuel's enthalpy (thermomechanical energy) is thereby greatly increased, also increasing the fuel's effective cetane number (ignitability) under compression ignition engine conditions. The high pressure/high temperature fuel may then be directly injected during the engine's compression stroke near TDC (preferably between 15 degrees prior to TDC and 30 degrees after TDC). The invention may be implemented in a conventional direct-injection CI engine with addition of a recuperator or other heater, and with injector(s) designed for higher fuel temperatures and higher injected volumes compared to diesel fuel injectors.

Thus, unlike the system described in the aforementioned U.S. Pat. No. 11,125,170, the hydrous (bio)fuel need not be reformed or otherwise thermochemically converted or can be only minimally converted—and can be directly used as the sole fuel (or, where the concepts of the prior patent application are incorporated, as one of the fuels). The waste heat/energy from exhaust is recovered and imparted to the fuel thermomechanically, rather than thermochemically. The invention results in numerous advantages, including:

(1) Achievement of ultra-high engine brake thermal efficiency (BTE) levels (i.e., the ratio of mechanical energy output to the chemical energy of the fuel), with BTE levels exceeding 60% being attainable (representing an improvement of 33% or more over conventional direct-injection CI engines).

(2) Elimination (or reduction) of the need for exhaust after-treatment, as many hydrous biofuels (such as hydrous ethanol and hydrous DME) have no or negligible soot emissions (including at stoichiometric conditions—i.e., where the in-cylinder fuel/oxygen ratio provides complete combustion of fuel and oxygen—in contrast with conventional direct-injection CI engines, which typically generate high soot emissions at stoichiometric conditions). Additionally, the water in the hydrous fuel tends to reduce NOx and soot emissions via mechanisms discussed below, with greater water concentration tending to result in lesser emissions.

(3) Any need to substantially or completely dewater hydrous biofuel is eliminated, thereby conserving much of the energy expended in distillation/dehydration of the hydrous biofuel, and lowering the cost of fuel production.

(4) The engine need not use premixed combustion (i.e., the injected fuel need not be thoroughly mixed with the cylinder air prior to ignition), thereby avoiding the control difficulties and load limitations arising from premixed combustion.

Particularly preferred versions of the invention implement one or more of the following features:

(1) A method of operating a compression ignition (diesel) engine wherein the method includes the step of injecting a hydrous fuel into a cylinder of a compression ignition engine to effect ignition of the hydrous fuel within the cylinder, wherein the cylinder solely contains air and a hydrous fuel during ignition.

(2) A method of operating a compression ignition (diesel) engine wherein the method includes the steps of first pressurizing a hydrous fuel, and then injecting the pressurized hydrous fuel into a cylinder of the compression ignition engine during one or more of a compression stroke of the compression ignition engine and an expansion stroke of the compression ignition engine to effect ignition of the hydrous fuel within the cylinder.

(3) A compression ignition engine system including a compression ignition engine; a fuel tank configured to contain a hydrous fuel; a fuel pump configured to supply the hydrous fuel to the compression ignition engine; a recuperator situated between the fuel pump and the compression ignition engine, wherein the recuperator is configured to transfer heat from exhaust from the compression ignition engine to the hydrous fuel; and an injector configured to inject the heated hydrous fuel into a cylinder of the compression ignition engine.

In the foregoing versions of the invention, one or more of the following features is preferably present:

(a) The hydrous fuel preferably contains at least 20% water by mass, and more preferably at least 40% water by mass. The fuel may be, for example, alcohol (e.g., ethanol), which preferably constitutes at least 20% of the hydrous fuel by mass; dimethyl ether (DME), which preferably constitutes at least 15% of the hydrous fuel by mass; diatomic hydrogen ($H_2$), which preferably constitutes at least 4% of the hydrous fuel by mass; and/or diesel fuel (whether derived from petroleum or from biomass), which preferably constitutes at least 10% of the hydrous fuel by mass.

(b) The hydrous fuel is preferably pressurized to a pressure of at least 50 bar prior to injection into the cylinder of the compression ignition engine (e.g., via the aforementioned fuel pump).

(c) The hydrous fuel is preferably heated to a temperature of at least 500 K prior to injection into the cylinder of the compression ignition engine. Such heating is preferably effected by heat transfer from the engine's exhaust gas (e.g., via the aforementioned recuperator).

(d) The hydrous fuel is preferably injected into the cylinder of the compression ignition engine between 15 degrees before top dead center (BTDC) and 30 degrees after top dead center (ATDC).

(e) The mass of the hydrous fuel injected into the cylinder of the compression ignition engine is within 20% of the mass needed to effect stoichiometric combustion.

Further advantages, features, and objects of the invention will be apparent from the following detailed description of the invention in conjunction with the associated drawings.

BRIEF DESCRIPTION OF THE DRAWINGS

FIG. 1 is a schematic depiction of an engine system exemplifying the invention.

DETAILED DESCRIPTION OF EXEMPLARY VERSIONS OF THE INVENTION

Expanding on the discussion above, FIG. 1 illustrates an exemplary engine system 10 having a fuel tank 100 which contains a hydrous biofuel (e.g., hydrous ethanol having 47% ethanol and 53% water by mass, which is representative of lightly distilled/dehydrated ethanol from a production facility). This is merely an exemplary hydrous biofuel, and hydrous biofuels with other water-to-carbon ratios are possible (e.g., with ethanol-to-water ratios of approximately 40/60 to 95/5 by mass).

A fuel pump 102 receives the fuel from the fuel tank 100 and pressurizes it to 50-500 bar (preferably 100-300 bar). The pressurized fuel is provided to a recuperator (heat exchanger) 106 where the fuel is heated by exhaust gases from the exhaust manifold 108, e.g., to 650-1100 K (preferably 700-900 K). Any suitable recuperator 106 may be used, with greater gains in brake thermal efficiency being realized with greater heat transfer from the exhaust gases. Recuperators such as those used in gas turbine engines are typically suitable for use. The pressurized and heated fuel is then provided to a diesel injection system 110, here depicted as a common rail injection system having several injectors 112, one per engine cylinder 114. The injectors 112 differ from conventional automotive diesel injectors insofar as they require high injection mass, with the capability to inject high temperature and low density fuel charges with 1.75 to 3.5 times the mass as those provided for a corresponding engine system utilizing only diesel fuel: as the water content of the fuel increases, so must the mass of an injected charge. Injection volume is also greatly increased versus standard diesel injection, as the high temperature of the fuel-water charge imparts significant volumetric expansion.

Now considering the system's air intake, looking near the bottom left of FIG. 1, ambient air (with a pressure at or near 1 bar, and temperature at or near 300 K) is preferably pressurized by a compressor (e.g., a turbocharger) 116, typically to 1.5-2.5 bar, 300-500 K, prior to supply to an intake manifold 118 (and thus to the engine cylinders 114).

Within the cylinders 114, fuel charges are injected near TDC (top dead center, i.e., where the pistons provide minimum cylinder volume) during the compression stroke, preferably between 15 degrees before TDC (BTDC) and 30 degrees after top dead center (ATDC) (and more preferably between 10 degrees BTDC and 15 degrees ATDC), such that the fuel is ignited upon or very shortly after injection. Because hydrous fuels tend to exhibit longer ignition delays than conventional diesel fuel, one or more pilot injections (i.e., earlier ignition-promoting injections of low volume) may be provided to promote ignition of later injections. Any such pilot injections are preferably provided at 30 to 20 degrees BTDC (before top dead center) or thereafter, preferably having a duration of 2-5 degrees of crankshaft rotation, and preferably each constituting between 5-15% of the total mass of fuel injected per cylinder 114, per cycle. Such pilot injections can also help reduce the rate of pressure rise within the cylinders 114, decreasing engine noise and potential damage. As noted previously, the overall fuel injection mass is greater than that used for conventional diesel fuels, with the amount of hydrous ethanol being injected typically being up to approximately 1.75-3.5 times the diesel-only injection mass for a given load, depending on the water-to-fuel ratio used. As discussed below, other hydrous fuels may require up to approximately 10 times the diesel-only injection mass.

Using the foregoing strategy, the engine 10 operates in substantially the same manner as it would during conventional diesel operation, but with impressive gains in brake thermal efficiency (BTE)—approximately 21% improvement—over conventional diesel operation. At the same time, the engine 10 provides far less nitric oxide (NOx) and soot emissions, typically with NOx emissions being between 2-3 grams per kilowatt-hour of brake power, and negligible soot emissions. Such emissions can be further reduced with a suitable emissions reduction system. FIG. 1 illustrates the exhaust manifold 108 passing the exhaust gas through the recuperator 106 to heat the fuel prior to injection, then through a turbine 120 driving the compressor 116 of the turbocharger, and finally to an emissions reduction system 122. The exemplary emissions reduction system 122 might here include a Diesel Oxidation Catalyst (DOC) filter 122*a* for reduction of unburned hydrocarbon and carbon monoxide emissions, and a Selective Catalytic Reduction (SCR) system 122*b* for reduction of NOx. In the DOC filter 122*a*, a metal and/or ceramic mesh catalyst promotes oxidation of carbon monoxide and unburned hydrocarbons to carbon dioxide and water. In the SCR system, a Diesel Exhaust Fluid (DEF) doser 124 injects a reductant (typically urea and water) into the exhaust gas so that a subsequent SCR catalyst 122*b* and an ammonia ($NH_3$) catalyst 122*c* cause NOx to react to produce harmless nitrogen gas and water vapor. Other emissions reduction components can be used in addition to or instead of the SCR and DOC systems, e.g., an exhaust gas recirculation (EGR) system (not shown), commonly used for NOx reduction, wherein a portion of the exhaust gas is recirculated back to the cylinders 114 to form a portion of the cylinder air. (In this respect, where this document refers to "air" within a cylinder 114 prior to ignition, this should be understood as encompassing atmospheric air alone, or in combination with recirculated exhaust gas.) A passive three-way catalyst (TWC) system 122*d* is another possible emissions reduction component which is particularly useful when the engine system 10 of FIG. 1 operates at or near a stoichiometric fuel-air ratio, in which case the DOC filter 122*a*, SCR catalyst 122*b*, and NH3 catalyst 122*c* (and DEF dosser 124) may be unnecessary.

It is notable that emissions decrease as water percentage increases in the hydrous ethanol. This is believed to occur because in conventional diesel combustion, NOx is typically produced as a result of high cylinder temperatures, and soot is typically produced in the fuel-rich regions upstream from the flame. With hydrous fuels, when a sufficiently high percentage of water is used, cylinder temperatures are decreased, and temperatures in the fuel-rich upstream region are too low to support soot formation. The invention can therefore potentially allow elimination of NOx and soot emissions with the use of mixing controlled combustion, i.e., by adjustment of injection (and thus the rate of fuel/air mixing) to adjust the combustion rate (and thus peak cylinder temperature).

While the foregoing description focused on the use of hydrous ethanol as the hydrous biofuel, other hydrous biofuels, e.g., hydrous methanol or hydrous dimethyl ether (DME), might be used instead with appropriate adjustment of the arrangement described above (in particular, the volume and temperature of the injected fuel charge). Investigations indicate that hydrous DME may be a particularly suitable hydrous biofuel. DME, which is commonly produced by dehydration of methanol, is gaseous at ambient temperature and pressure, but liquefies at modest pressure (approximately 6 bar) and is soluble in water. Using the engine system 10 with 17.6% DME/82.4% water (by mass), and an injected fuel temperature of 650 K, the engine achieved greater than 60% brake thermal efficiency (BTE)—an improvement of approximately 33% over conventional diesel operation—with negligible NOx emissions, potentially allowing for the elimination of the SCR and ammonia NOx after-treatment systems 122*b* and 122*c*. Owing to the high cetane number of DME, injected hydrous DME can ignite at lower temperatures than those preferred for use with hydrous ethanol, with injected fuel temperatures of 700 K and less being suitable, including down to ambient temperature. This beneficially reduces high-temperature material/performance requirements for the recuperator 106 and for fuel system components such as the injectors 112, and eases operation under conditions where there is insufficient exhaust energy available to achieve high injected fuel temperatures (e.g., during engine warm-up and transient conditions). Moreover, it was found that thermal efficiency gains are maximized, and engine-out NOx and soot emissions are minimized, by maximizing the water content of the hydrous DME. However, the hydrous DME fuel charges need have significant mass—requiring as much as 10 times the mass as those provided for a comparable engine system utilizing only diesel fuel—and thus higher-capacity injectors are required in comparison to those used where the engine system 10 operates using hydrous ethanol.

Similarly, hydrous hydrogen might be used as a fuel with appropriate adjustment of the arrangement described above. Hydrogen can be regarded as a biofuel, i.e., a fuel generated from biomass, insofar as it is often produced via reforming of biomass (with the hydrogen being a component of the syngas reformation product), or as a "traditional" fuel when produced from matter other than biomass (e.g., via electrolysis of water). Hydrogen ($H_2$) is gaseous at ambient temperature and pressure and not easily liquified under standard automotive conditions, and has weak water solubility at ambient conditions, but water solubility greatly increases at the pressures used in conventional automotive hydrogen tanks (typically 350 bar or greater). Using the foregoing engine system 10 with 4% or more hydrogen by mass (and 96% or less water by mass), and an injected fuel temperature of 700 K, the advantages described above regarding use of dimethyl ether (DME) may be obtained, save that an even greater brake thermal efficiency (BTE) of 64% or more (an improvement of 42% or more over conventional diesel operation) is attainable. As the cetane number of hydrogen is only slightly below that of DME (i.e., it ignites at a temperature only slightly above the ignition temperature of DME), injected fuel temperatures of 750 K and less are suitable, including down to ambient temperature. As with the prior examples, the injected hydrous fuel mass is significantly greater than those used in a comparable engine system utilizing only diesel fuel (again, up to approximately 10 times a conventional injected diesel fuel mass).

The invention is particularly suitable for use with hydrous biofuels because such hydrous biofuels often result from production processes, with dehydration steps then being needed to ready the biofuels for conventional diesel use. However, the invention need not be used with biofuels, and may be used with conventional (refinery-produced) fuels having added water. As an example, when the invention is implemented with conventional petroleum-derived diesel fuel (using 10% or more diesel fuel by mass and 90% or less water by mass), the invention exhibits gains in brake thermal efficiency (BTE) similar to those described above for DME, and hydrogen. Analogous results arise when hydrous biodiesel (i.e., diesel biofuel) is used. Here it is notable that many biodiesel production processes require "washing" of unfinished biodiesel with water, followed by separation of the water from the finished biodiesel, and the invention might therefore allow direct use of the hydrous unfinished biodiesel in an engine without the need to perform water separation.

The use of hydrous forms of more highly reactive fuels, i.e., higher-cetane fuels (such as DME, hydrogen, and (bio) diesel) has advantages over the use of lower reactivity fuels (such as ethanol/alcohols, methane, and gasoline) since the invention can tolerate higher water content in higher-cetane fuels. Higher water content generally corresponds to higher waste heat recovery, higher brake thermal efficiency (BTE), and lower engine-out NOx and soot emissions.

The invention may also be suitable for use with fuels having low-cetane, low-energy contents other than or in addition to water, such as glycerol/glycerin, a common byproduct of biodiesel production.

Throughout this document, where a measurement or other value is qualified by the term "approximately," "about," "nearly," "roughly," or the like—for example, "approximately 50% water"—this can be regarded as referring to a variation of 10% from the noted value. Thus, as an example, "approximately 50% water" can be understood to mean within 5% (i.e., 10% of 50%) of 50% water.

Throughout this document, where the terms "primarily," "substantially," and the like are used, these should be regarded as meaning "in major part." For example, a fuel formed primarily or substantially of ethanol contains over half ethanol.

The description set out above is merely of exemplary preferred versions of the invention, and it is contemplated that numerous additions and modifications can be made. These examples should not be construed as describing the only possible versions of the invention, and the true scope of the invention will be defined by the claims included in any later-filed utility patent application claiming priority from this provisional patent application.

What is claimed is:

1. A compression ignition engine method including the step of injecting a hydrous fuel into a cylinder of a compression ignition engine to effect ignition of the hydrous fuel within the cylinder, wherein:

a. the cylinder solely contains:
   (1) air, and
   (2) a hydrous fuel containing at least 20% water by mass,
   during ignition,
b. the hydrous fuel is:
   (1) pressurized to a pressure of at least 50 bar,
   (2) heated to a temperature of at least 550 K, and
   (3) in a liquid or supercritical phase,
   prior to injection into the cylinder of the compression ignition engine.

2. The method of claim 1 wherein the hydrous fuel is heated to a temperature of at least 550 K by exhaust gas from the compression ignition engine.

3. The method of claim 1 wherein the hydrous fuel is injected into the cylinder of the compression ignition engine between 15 degrees before TDC (BTDC) and 30 degrees after top dead center (ATDC).

4. The method of claim 1 wherein the mass of the hydrous fuel injected into the cylinder of the compression ignition engine is within 20% of the mass needed to effect stoichiometric combustion.

5. The method of claim 1 wherein the hydrous fuel contains at least 20% alcohol by mass.

6. The method of claim 1 wherein the hydrous fuel essentially consists of ethanol and water.

7. The method of claim 1 wherein the hydrous fuel essentially consists of dimethyl ether (DME) and water.

8. A compression ignition engine method including the steps of:

a. pressurizing a hydrous fuel to a pressure of at least 50 bar,
b. heating the hydrous fuel to a temperature of at least 550 K,
c. injecting the pressurized and heated hydrous fuel into a cylinder of the compression ignition engine in a liquid or supercritical phase during one or more of:
   (1) a compression stroke of the compression ignition engine, and
   (2) an expansion stroke of the compression ignition engine,
   to effect ignition of the hydrous fuel within the cylinder.

9. The method of claim 8 wherein the hydrous fuel contains at least 20% water by mass.

10. The method of claim 9 wherein the hydrous fuel contains one or more of:

a. at least 20% alcohol by mass,
b. at least 15% dimethyl ether (DME) by mass,
c. at least 4% hydrogen (H2) by mass, and
d. at least 10% diesel fuel by mass.

11. The method of claim 10 wherein the hydrous fuel is heated by exhaust gas from the compression ignition engine prior to injection into the cylinder.

12. The method of claim 8 wherein the hydrous fuel is injected into the cylinder of the compression ignition engine between 15 degrees before TDC (BTDC) and 30 degrees after top dead center (ATDC).

13. The method of claim 8 wherein the hydrous fuel essentially consists of hydrous ethanol containing at least 20% water by mass.

14. The method of claim 8 wherein the hydrous fuel essentially consists of hydrous dimethyl ether (DME) containing at least 15% DME by mass.

15. A compression ignition engine system including:

a. a compression ignition engine,
b. a fuel tank configured to contain a hydrous fuel,
c. a fuel pump configured to supply the hydrous fuel to the compression ignition engine,
d. a recuperator:
   (1) situated between the fuel pump and the compression ignition engine,
   (2) configured to transfer heat from exhaust from the compression ignition engine to the hydrous fuel,
e. an injector configured to inject the heated hydrous fuel into a cylinder of the compression ignition engine, wherein i. the fuel pump is configured to pressurize the hydrous fuel to a pressure of at least 50 bar for supply to the injector, and
ii. the recuperator is configured to heat the hydrous fuel to a temperature of at least 550 K.

16. The method of claim 15 wherein the hydrous fuel contains at least 20% water by mass.

17. The method of claim 15 wherein the hydrous fuel contains at least 20% alcohol by mass.

18. The method of claim 17 wherein the hydrous fuel essentially consists of ethanol and water.

19. The method of claim 16 wherein the hydrous fuel essentially consists of dimethyl ether (DME) and water.

20. The method of claim 1 wherein the hydrous fuel is pressurized to a pressure of at least 100 bar.

* * * * *